US007073680B2

(12) United States Patent
Boback et al.

(10) Patent No.: US 7,073,680 B2
(45) Date of Patent: Jul. 11, 2006

(54) TAMPER-RESISTANT CONTAINER WITH TAMPER-EVIDENT FEATURE AND METHOD OF FORMING THE SAME

(75) Inventors: Peter Boback, Stratford, CT (US); Robert Sellari, Shelton, CT (US); Bruce Stein, Easton, CT (US); Daniel A. Landan, Oxford, CT (US); Tadeusz J. Klimaszewski, Hamden, CT (US)

(73) Assignee: Inline Plastics Corporation, Shelton, CT (US)

( * ) Notice: Subject to any disclaimer, the term of this patent is extended or adjusted under 35 U.S.C. 154(b) by 0 days.

(21) Appl. No.: 11/065,681

(22) Filed: Feb. 24, 2005

(65) Prior Publication Data

US 2005/0184070 A1 Aug. 25, 2005

Related U.S. Application Data

(63) Continuation-in-part of application No. 10/895,687, filed on Jul. 21, 2004.

(60) Provisional application No. 60/489,093, filed on Jul. 21, 2003.

(51) Int. Cl.
*B65D 41/32* (2006.01)

(52) U.S. Cl. ..... 220/266; 220/4.21

(58) Field of Classification Search ..... 220/266, 220/270, 4.21, 835, 780–784, 4.23, 4.25
See application file for complete search history.

(56) References Cited

U.S. PATENT DOCUMENTS

| | | | | |
|---|---|---|---|---|
| 4,433,793 | A * | 2/1984 | Ingemann | 220/276 |
| 4,535,889 | A * | 8/1985 | Terauds | 206/527 |
| 5,040,695 | A * | 8/1991 | Adams et al. | 220/270 |
| 5,219,087 | A * | 6/1993 | Christensson | 220/270 |
| 5,287,959 | A * | 2/1994 | Hansen et al. | 220/787 |
| D352,000 | S * | 11/1994 | Hansen et al. | D9/429 |
| 5,507,406 | A * | 4/1996 | Urciuoli et al. | 220/269 |
| 5,573,134 | A * | 11/1996 | Chenault et al. | 220/276 |
| 5,897,011 | A * | 4/1999 | Brilliant et al. | 220/4.23 |
| 5,931,332 | A * | 8/1999 | Mygatt et al. | 220/270 |
| 2003/0052133 | A1 | 3/2003 | Hayes et al. | |

FOREIGN PATENT DOCUMENTS

| | | | | |
|---|---|---|---|---|
| DE | 78 16 353 U1 | | 11/1978 | |
| DE | 4418935 | * | 12/1995 | 220/270 |
| DE | 1999-083197 | * | 8/1999 | 220/270 |
| EP | 0 752 374 A1 | | 1/1997 | |
| GB | 2257118 A | | 1/1993 | |

* cited by examiner

*Primary Examiner*—Lien M. Ngo
(74) *Attorney, Agent, or Firm*—Edwards Angell Palmer & Dodge LLP

(57) ABSTRACT

A tamper-resistant container with tamper-evident features which includes a cover portion defining a outwardly extending peripheral flange, a base portion defining an upper peripheral edge, a hinge joining the outwardly extending peripheral flange with the base portion and an engagement mechanism for maintaining the peripheral flange adjacent to the upper peripheral edge when the container is closed. The upper peripheral edge includes an upwardly projecting bead extending substantially about the perimeter of the base portion that is configured to render the outwardly extending flange of the cover portion relatively inaccessible when the container is closed. The hinge includes a frangible section, which upon severing, provides a projection that extends out beyond the upwardly projecting bead of the upper peripheral edge of the base portion, for facilitating the disengagement of the engagement mechanism and removal of the cover portion from the base portion to open the container.

27 Claims, 10 Drawing Sheets

FIG. 3
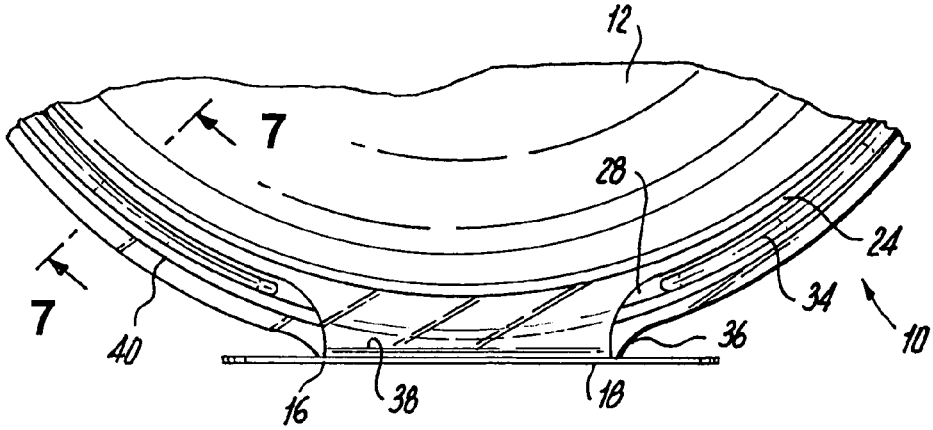
FIG. 4
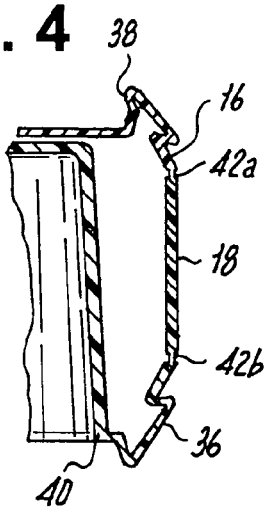
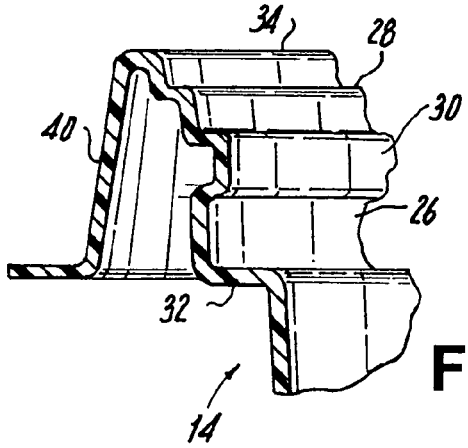
FIG. 5
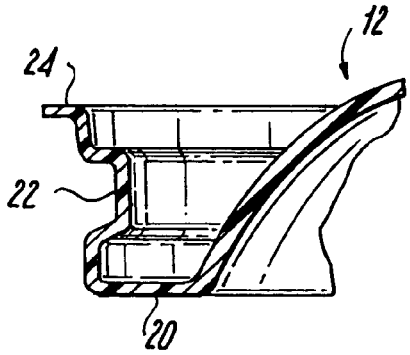
FIG. 6
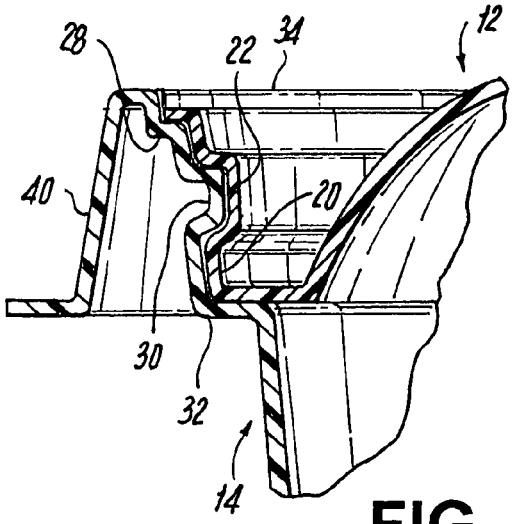
FIG. 7

FIG. 10
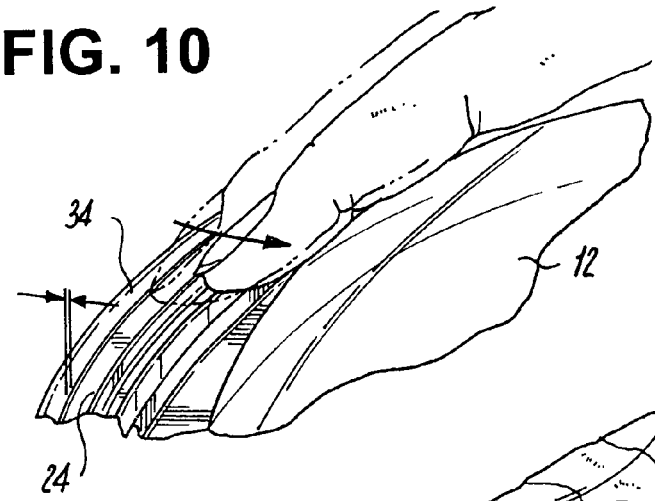
FIG. 11
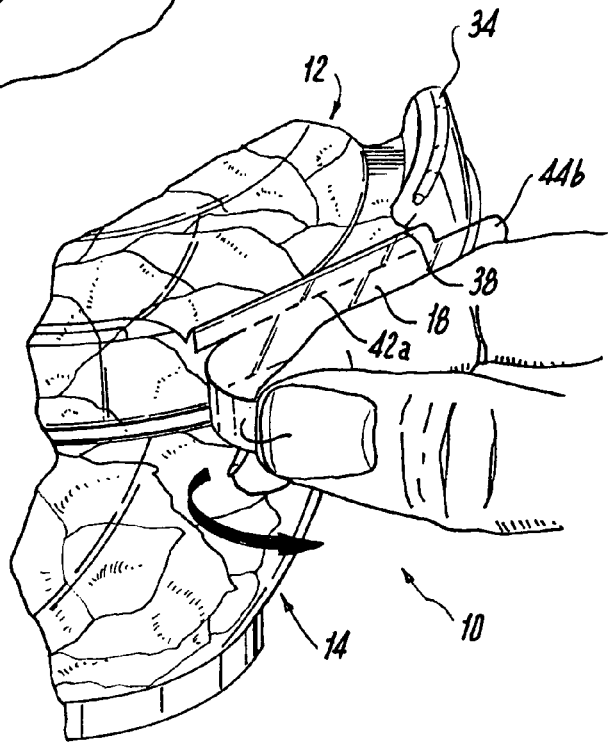
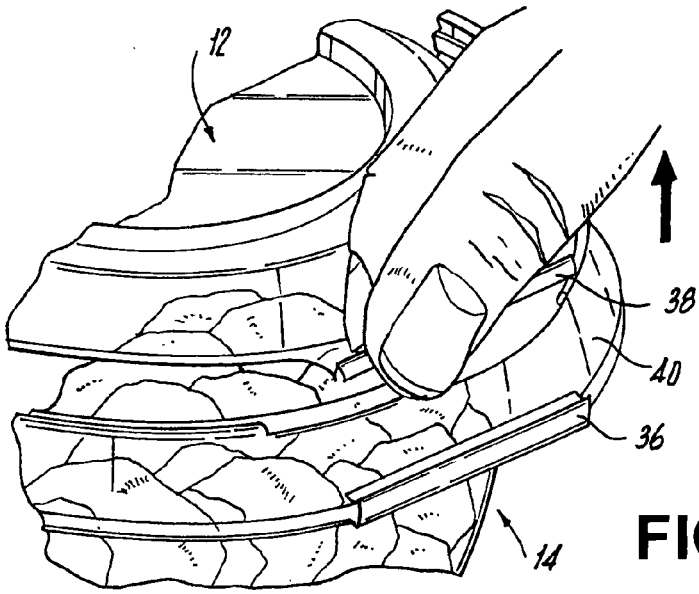
FIG. 12

FIG. 16
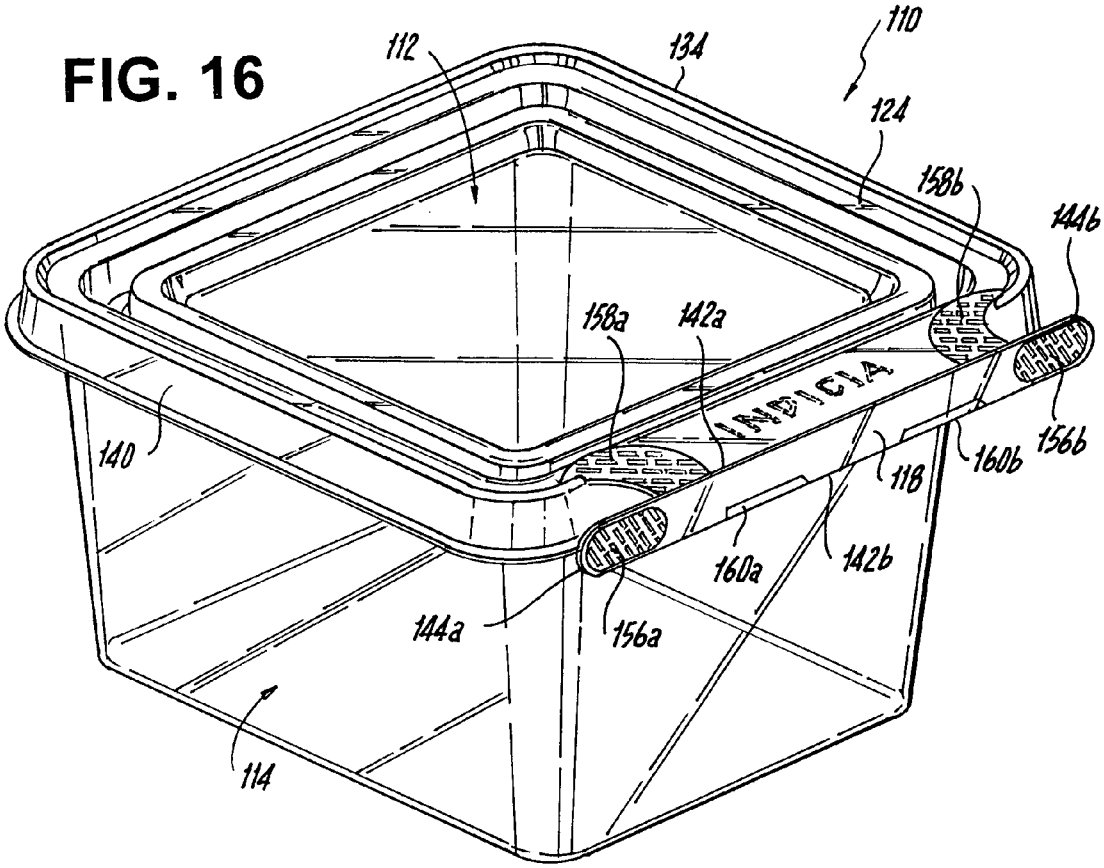
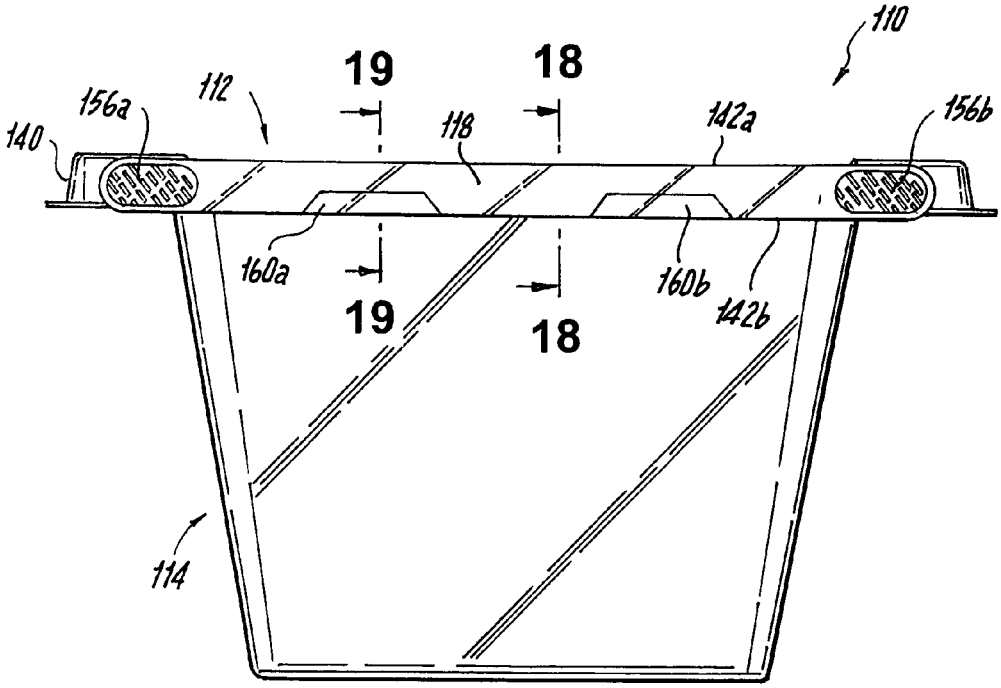
FIG. 17

TAMPER-RESISTANT CONTAINER WITH TAMPER-EVIDENT FEATURE AND METHOD OF FORMING THE SAME

CROSS-REFERENCE TO RELATED APPLICATION(S)

The subject application is a continuation in part of U.S. patent application Ser. No. 10/895,687 filed Jul. 21, 2004, which claims the benefit of priority to U.S. Provisional Patent Application No. 60/489,093 filed Jul. 21, 2003, the disclosures of which are herein incorporated by reference in their entirety.

BACKGROUND OF THE INVENTION

1. Field of the Invention

The subject invention is directed to containers and packaging, and more particularly, to containers and packaging that incorporate tamper-resistant and tamper-evident features.

2. Background of the Related Art

Disposable containers for packaging, distributing, displaying or otherwise housing consumer items, especially perishable foods, are becoming increasingly important. Historically, perishable products had to be brought to market and sold quickly before exposure to the atmosphere caused the products to lose their freshness.

The advent of plastics resulted in many products being wrapped or packaged in plastic, both in the form of flexible plastic bags and solid plastic containers. The use of plastics in the modern-day convenience food industry has significantly improved the "shelf life" of perishable products, allowing both merchants and their customers to store the products for longer periods of time, resulting in substantial savings.

It has been found that consumers like recloseable packages, particularly for comestible products, especially in circumstances where more than one serving of a comestible product is contained therein, in order to reduce drying out or other deterioration of the comestible food product. In addition, consumers prefer to visually inspect the food product within such containers prior to purchase. Thus, fabricating containers from clear see-through plastics is desirable. For example, packaging provided for bakery goods has often been in the form of clear, plastic clamshell packaging, because, among other things, such clear, plastic clamshell packaging, provides a baked-on-the-premises image which grocery retailers have found to be especially appealing to consumers.

Typically, plastic containers will include a fairly rigid lid and base, although they may be subject to some amount of flexure. The lid provided must be capable of properly and effectively sealing the container, yet the container must be constructed so that the lid is relatively easy to remove, and even replace, since it is expected that the container and lid would normally be reused.

In addition to the aforementioned consumer design preferences, it is desirable to fabricate containers that include features which either deter unauthorized tampering or clearly indicate whether unauthorized tampering has occurred, or both. These tamper-resistant/evident features typically include structural elements which, when the container is tampered with or opened without authorization, enable the consumer to easily visually recognize such tampering so that the product can then be rejected. Such tamper-resistant/evident elements are important for, among other things, deterring theft and preventing the loss of product and income for the seller, as well as instilling consumer confidence in the integrity of the contents within the container and confidence in the ability of the seller and/or manufacturer to provide and maintain quality goods.

Thus, there is a compelling interest in the development of containers having consumer-preferable design elements, such as recloseability features which are reliable and easy to operate, along with tamper-resistant/evident features that deter tampering and clearly indicate whether tampering has occurred, and which are also reliable without being burdensome to the legitimate consumer. Accordingly, the present invention is directed to a container that meets these needs.

SUMMARY OF THE DISCLOSURE

The present invention meets the aforementioned needs, while also improving upon and solving problems associated with previous containers by providing, among other things, a tamper-resistant container with tamper-evident features (also referred to herein as a "tamper-resistant/evident container") that includes a cover portion defining an outwardly extending peripheral flange and a base portion defining an upper peripheral edge. The upper peripheral edge of the base portion includes, at least in part, an upwardly projecting bead extending substantially about the perimeter of the base portion. This bead is configured and dimensioned to render the outwardly extending flange of the cover portion relatively inaccessible when the container is closed. Preferably, the container includes an engagement mechanism, which may include a device or structure, among other things, for maintaining the peripheral flange adjacent to the upper peripheral edge when the container is closed.

The container can further include a hinge joining the outwardly extending flange of the cover portion with the base portion. The hinge preferably includes a frangible section, which upon severing, provides a projection that extends out beyond the upwardly projecting bead of the upper peripheral edge of the base portion to facilitate disengagement of the engagement mechanism and removal of the cover portion from the base portion. Preferably, the frangible section of the hinge is delimited at least in part by a pair of parallel score lines, and more preferably, is further delimited by a plurality of spaced apart notches, depressions or nicks associated with the score lines.

In another embodiment, the container includes a skirt which depends downwardly from the upper peripheral edge of the base portion. Preferably, the hinge extends from the lower edge of the skirt to the outwardly extending flange of the cover portion.

In a further embodiment, the aforementioned engagement mechanism is non-permanent and facilitates the reattachment of the cover portion with the base portion. Preferably, the engagement mechanism urges the peripheral flange of the cover portion and the upper peripheral edge of the base portion to remain adjacent with respect to each other when the container is closed by, among other things, securing the cover portion to the base portion.

In one embodiment, the engagement mechanism includes corresponding male and female structural members which are configured and dimensioned to form a secure engagement with each other. The male engaging member can be defined on the base portion and the female engaging member can be defined on the cover portion.

The container can also include at least one supporting rib defined on the base portion. In one embodiment, the supporting rib includes a plurality of elongated, arcuate portions positioned adjacently with respect to one another.

The present invention is also directed to a tamper-resistant/evident container that includes a cover portion defining a outwardly extending peripheral flange, a base portion defining an upper peripheral edge, a hinge joining the outwardly extending flange of the cover portion with the base portion, and an engagement mechanism, which may be a device or structure, among other things, for maintaining the peripheral flange adjacent to the upper peripheral edge when the container is closed.

In one embodiment of this container, the engagement mechanism can be non-permanent and facilitate the reattachment of the cover portion with the base portion. The engagement mechanism can also urge the peripheral flange of the cover portion and the upper peripheral edge of the base portion to resist separation when the container is closed and remain in place.

In another embodiment of this container, the engagement mechanism can include corresponding male and female engaging members, as discussed above.

This container of the present invention can also include one or more supporting ribs defined on the base portion, which, as discussed above, preferably include a plurality of elongated arcuate portions positioned adjacently with respect to one another. In a preferred embodiment, the male engaging member of an engagement mechanism having male and female engaging members, projects from at least one supporting rib.

The present invention is also directed to a container that includes a cover portion defining a outwardly extending peripheral flange, a base portion defining an upper peripheral edge forming at least in part an upwardly projecting bead extending substantially about the perimeter of the base portion and configured to render the outwardly extending flange of the cover portion relatively inaccessible when the container is closed, a hinge joining the outwardly extending flange of the cover portion with the base portion, a male engaging member defined on the base portion to project towards the cover portion when the container is closed, and a female engaging member having a receiving portion defined on the cover portion to correspond to the position of the male engaging member when the container is closed for receiving the male engaging member therein and forming a non-permanent engagement between the male and female engaging members when the container is closed.

In one embodiment of the aforementioned container constructed in accordance with the present invention, the engagement of the male and female members provides resistance to any force applied to remove the cover portion and base portion. Preferably, the engagement of the male and female members also urges the outwardly extending peripheral flange of the cover portion into contact with the peripheral edge of the base portion.

These and other aspects of the present invention will become more readily apparent to those having ordinary skill in the art from the following detailed description of the invention taken in conjunction with the drawings.

BRIEF DESCRIPTION OF THE FIGURES

So that those having ordinary skill in the art to which the subject invention pertains will more readily understand how to make and use the tamper-resistant/evident package disclosed herein, embodiments thereof will be described in detail below with reference to the drawings, wherein:

FIG. 3 is a partial top view of the container shown in FIG. 1, illustrating in particular the hinge having a frangible section or strip and projection associated therewith that extends beyond the upwardly projecting bead associated with the upper peripheral surface of the base portion;

FIG. 4 is a partial cross sectional view of the container shown in FIG. 1, taken along line 4—4 of FIG. 2, illustrating in particular the hinge having a frangible section and upper and lower projections or arms extending from the cover portion and base portion of the container;

FIG. 5 is a partial cross sectional view of the container shown in FIG. 1, taken along line 5—5 of FIG. 8, illustrating in particular the configuration of the base portion and the structural elements that facilitate a releasable/recloseable engagement with the cover portion;

FIG. 6 is a partial cross sectional view of the container shown in FIG. 1, taken along line 6—6 of FIG. 8, illustrating in particular the configuration of the cover portion and the structural elements that facilitate a releasable/recloseable engagement with the base portion;

FIG. 7 is a partial cross sectional view of the container shown in FIG. 1, taken along line 7—7 of FIG. 4, illustrating in particular the configuration of the base portion and cover portion when the container is closed and including the structural elements that facilitate a releasable/recloseable engagement between the base and cover portions;

FIG. 10 is a partial perspective view of the container shown in FIG. 1, illustrating in particular the manner in which the upwardly projecting bead on the base portion physically prevents access to the outer edge of the cover portion, making it difficult to separate the cover portion from the base portion;

FIG. 11 is a partial perspective view of the container shown in FIG. 1, illustrating in particular the manner in which the frangible section can be removed from the hinge;

FIG. 12 is a partial perspective view of the container shown in FIG. 1, illustrating in particular the upper and lower projections formed by removal of the frangible section and the manner in which the upper and lower projections facilitate separation of the cover portion from the base portion;

FIG. 16 is perspective view of a tamper-resistant/evident container constructed in accordance with the present invention in an exemplary rectangular configuration having a base portion and cover portion connected to each other by a hinge having a frangible section;

FIG. 17 is a side view of the container shown in FIG. 16, illustrating in particular the hinge having a frangible section or strip, patterned sections on opposing ends thereof, and tabs defined by the frangible section score line;

DETAILED DESCRIPTION OF THE PREFERRED EMBODIMENTS

Figure 1:
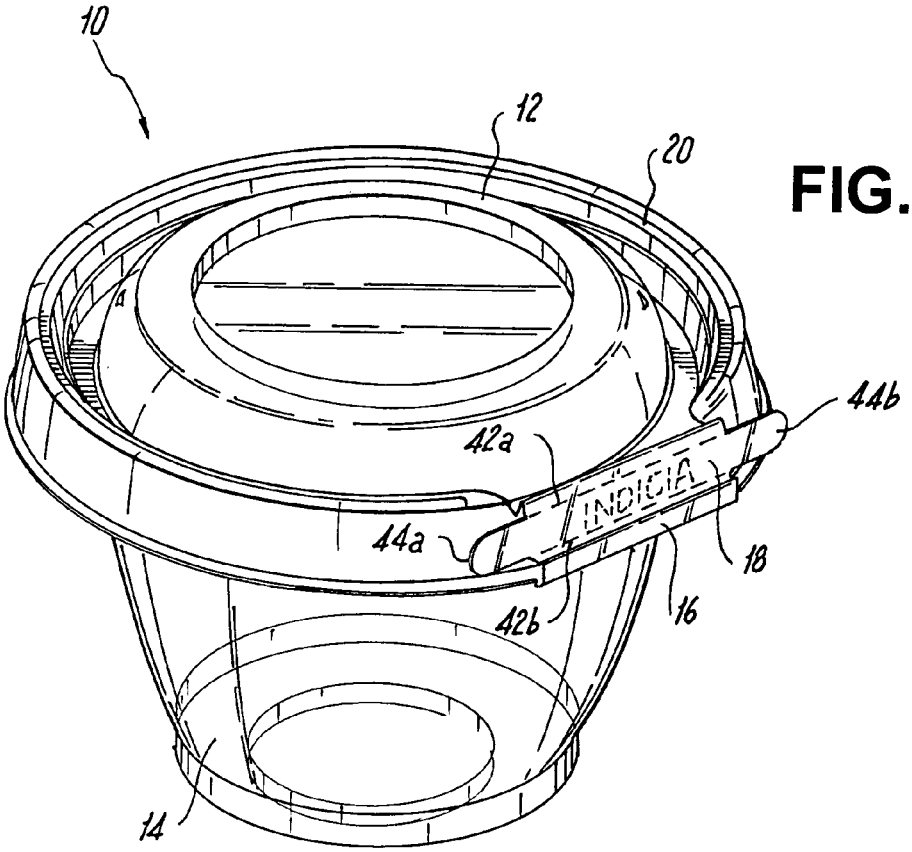
FIG. 1 is a perspective view of a tamper-resistant/evident container constructed in accordance with the present invention in an exemplary circular configuration having a base portion and cover portion connected to each other by a hinge having a frangible section.

The advantages of a tamper-resistant/evident container constructed in accordance with the present invention will become more readily apparent to those having ordinary skill in the art from the following detailed description of certain preferred and exemplary embodiments taken in conjunction with the drawings which set forth representative embodiments thereof, but are not intended to limit the scope of the present invention.

Unless otherwise apparent, or stated, directional references, such as "right," "left," "upper," "lower," "outward," "inward," etc., are intended to be relative to the orientation of a particular embodiment of the invention as shown in the first numbered view of that embodiment. In addition, a given reference numeral indicates the same or similar structure when it appears in different figures and like reference numerals identify similar structural elements and/or features of the subject invention.

Figure 2:
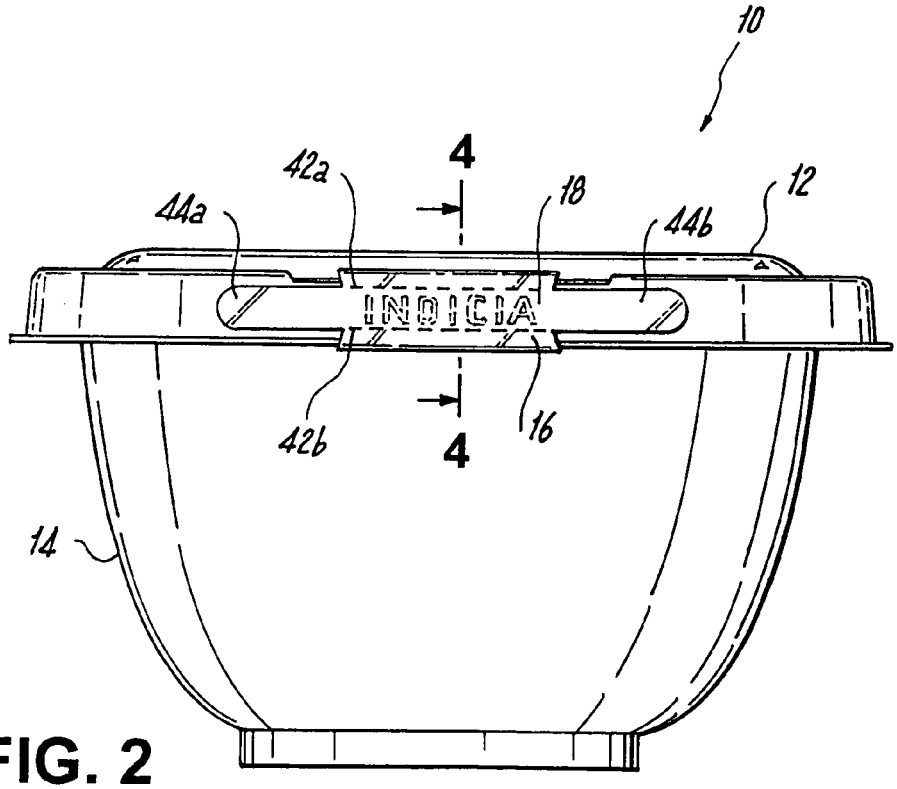
FIG. 2 is a side view of the container shown in FIG. 1, illustrating in particular the hinge having a frangible section or strip, and a suitable location for indicia to be printed thereon.
Figure 8:
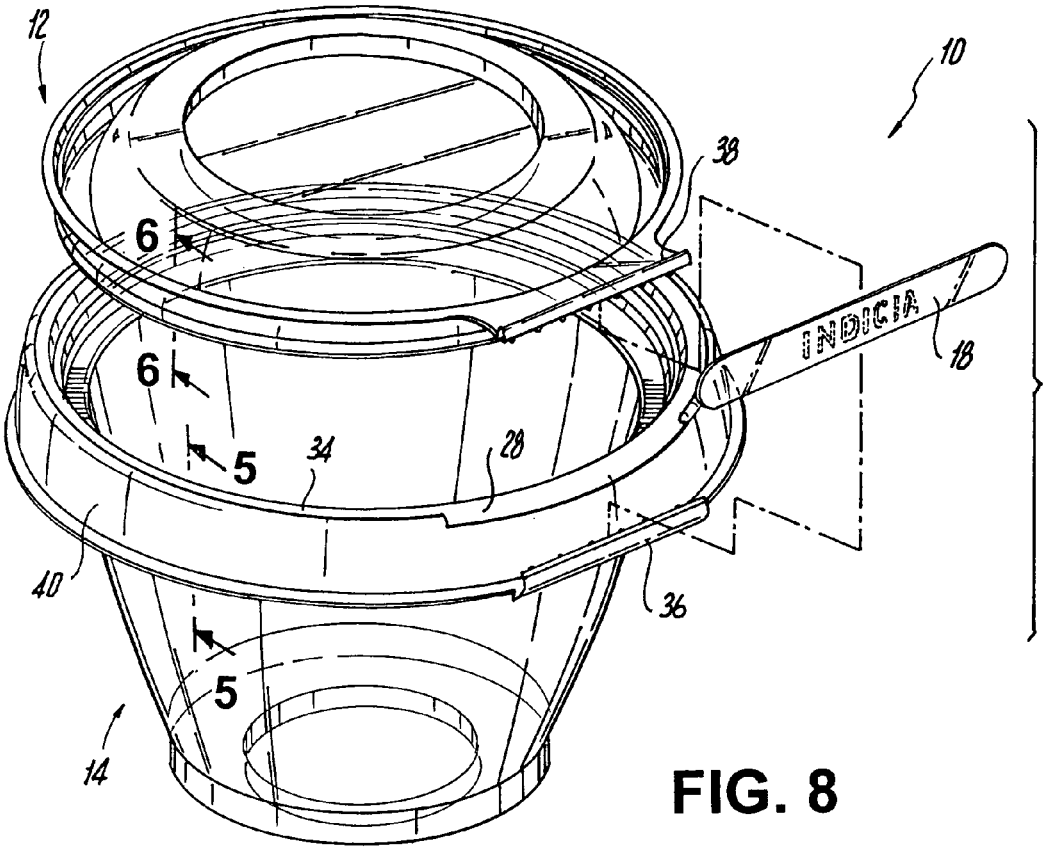
FIG. 8 is an exploded perspective view of the container shown in FIG. 1, illustrating in particular the operative association between the cover portion, base portion and frangible section.
Figure 9:
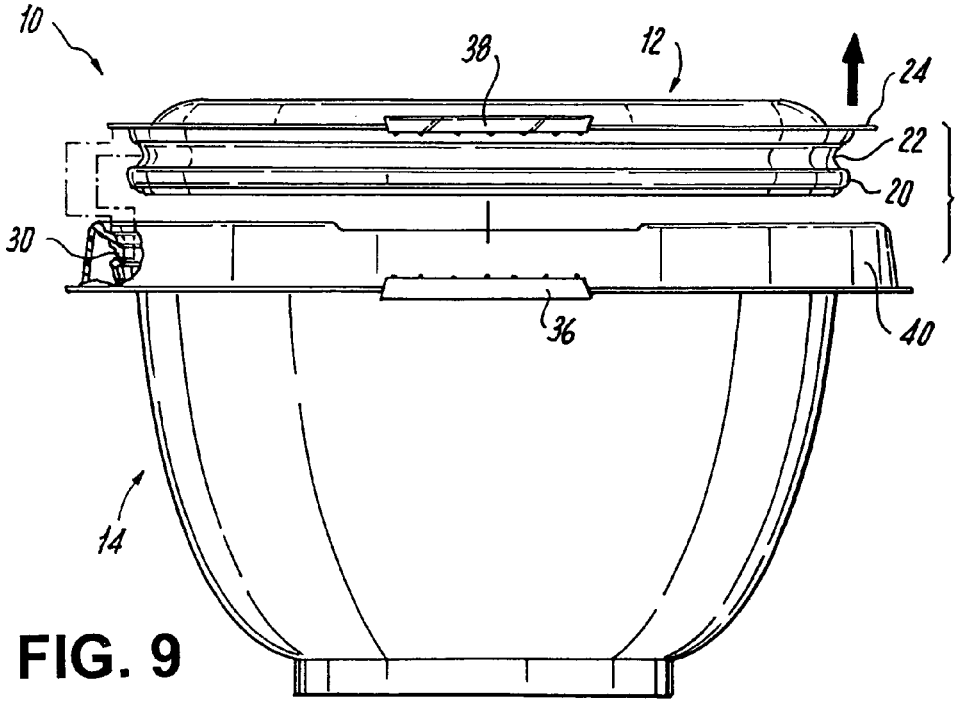
FIG. 9 is a side view of the container shown in FIG. 1, in which the frangible section has been removed, illustrating the manner in which the cover portion is separated from the base portion and the upper and lower projections or arms associated with the cover and base portions, respectively.

In accordance with an exemplary embodiment of the subject invention illustrated in FIGS. 1 and 2, the container 10 includes a generally circular cover portion 12 and a generally bowl-shaped base portion 14 joined together by a hinge 16. Hinge 16 includes a tamper-evident frangible section or pull strip 18, which, upon its removal, severs the integral connection between cover portion 12 and base portion 14.

In use, container 10 would be filled with the contents for which consumer protection is desired and cover portion 12 would be engaged with base portion 14. In accordance with the present invention, cover portion 12 and base portion 14 include structural features that facilitate the formation of a non-permanent engagement between cover portion 12 to base portion 14.

In this embodiment, the non-permanent engagement between cover portion 12 and base portion 14 is facilitated by, among other things, a peripheral locking shoulder 20 and an radially inward circumferential groove 22 formed below an outwardly extending peripheral flange 24 on cover portion 12, which can be seated within a corresponding mating circumferential recess 26 on base portion 14. Circumferential recess 26 on base portion 14 is formed below an upper peripheral rim 28 and includes a radially inward projecting rib 30 and a radially inwardly extending rim 32.

When cover portion 12 is closed on base portion 14, projecting rib 30 mates with circumferential groove 22 on cover portion 12 and extending rim 32 mates with locking shoulder 20 on cover portion 12. In addition, outwardly extending peripheral flange 20 on cover portion 12 abuts upper peripheral rim 28 on base portion 14.

Container 10 incorporates features which are intended to prevent and deter opening container 10 without first removing frangible strip 18 from hinge 16. In this embodiment, container 10 includes an upwardly projecting bead 34 on base portion 14 that extends substantially about the perimeter of peripheral rim 22 and is positioned to surround the outer edge of flange 24 of cover portion 12 when container 10 is closed. The position and upward extension of bead 34 is configured to hinder the relatively easy method of removing a cover from conventional containers that may resemble or have characteristics in common with container 10. As can be best viewed in FIG. 10, bead 34 physically blocks access to the edge of peripheral flange 24 on cover portion 12 from fingers or any other object that might normally be used for leverage to pry cover portion 12 from base portion 14.

Hinge 16 includes an upper outwardly projecting arm 36 connected to base portion 14, and a similar lower outwardly projecting arm 38, which is connected to cover portion 12. In particular, upper arm 36 is connected with a skirt 40 that projects downward from upper peripheral rim 28 and radially outward with respect to base portion 14. Lower arm 38 is connected with the peripheral flange 24. Upper and lower arms 36 and 38 are joined together by a common attachment to frangible strip 18 to form hinge 16.

Preferably, frangible strip 18 is delimited at least in part by a pair of parallel score lines 42*a*, 42*b* or areas that have been weakened or stressed during the forming process. Frangible strip 18 may be further delimited by a plurality of spaced apart areas in which material has been removed associated with the score lines, by a plurality of spaced apart depressions associated with the score lines, or by perforation lines. The width and depth of the areas and/or depressions can vary to control the tear resistance offered by frangible strip 18. Alternatively, the integral hinge 16 could be formed with a single score line or perforation line, rather than a pair of score lines. In this instance, the single score line could be severed to create a pair of projections which would be used to open the container.

In this embodiment, strip 18 includes laterally opposed grasping tabs 44*a* and 44*b* to provide a convenient location for gripping strip 18. Preferably, instructional indicia is imprinted on strip 18 to facilitate its removal from hinge 16 and/or consumer understanding of the significance of its removal as it relates to product tampering. Strip 18 and/or the instructional indicia preferably thereon can be colored or embossed, or otherwise fabricated to direct attention thereto.

As can be best viewed in FIGS. 11 and 12, detaching frangible strip 18 from hinge 16 of container 10 leaves behind upper and lower arms 36 and 38 on cover portion 12 and base portion 14, respectively. Upper and lower arms 36 and 38 extend outwardly from container 10 and can be used to facilitate removal of cover portion 12 from base portion 14, once strip 18 has been removed, by applying sufficient opposing force to disengage locking shoulder 20 from within circumferential recess 26.

The presence of bead 34 prevents unauthorized access to the contents of container 10 by making it difficult to pull cover portion 12 from base portion 14. If access to container 10 is desired, strip 18 must be removed so that upper and lower arms 36 and 38 are free to be used to leverage cover portion 12 from base portion 14. Cover portion 12 may be replaced on base portion 14 after container 10 is opened. Strip 18, however, once removed, is not replaceable. Thus, removal of strip 18 functions as a clear indicator of possible tampering, in that if strip 18 is partially or fully removed prior to purchase, it is readily apparent to a consumer that someone may have already gained access to the contents of container 10.

Figure 13:
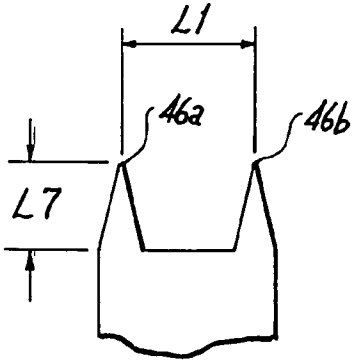
FIG. 13 is a side view of a two blade knife that can be used to form the frangible section of a container constructed in accordance with the present invention.
Figure 14:
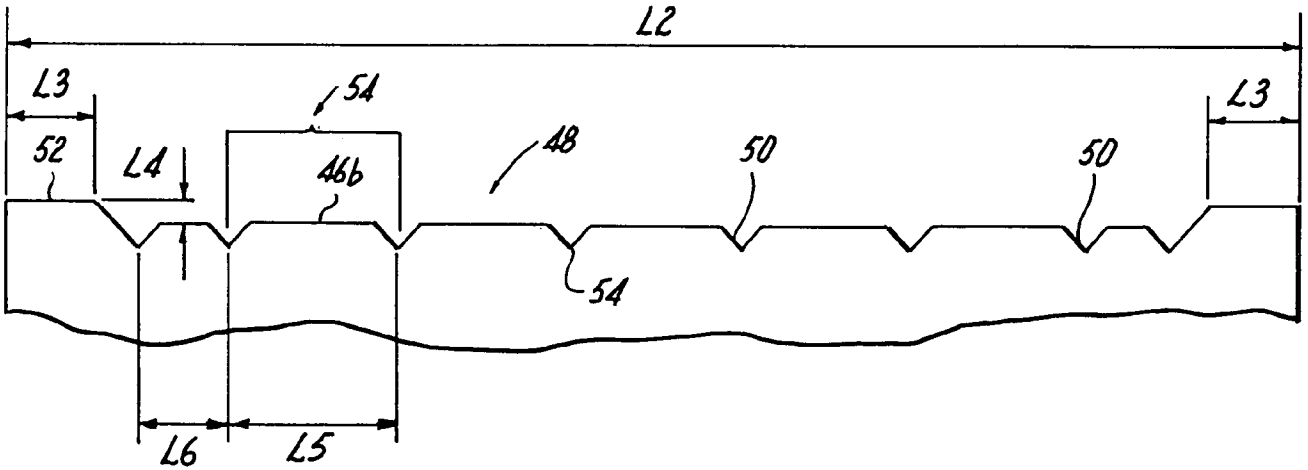
FIG. 14 is a front plan view of a first blade of the two blade knife of FIG. 13, illustrating the position of the nicks and cutting surfaces that can form a first score line of a frangible section of a container constructed in accordance with the present invention.
Figure 15:
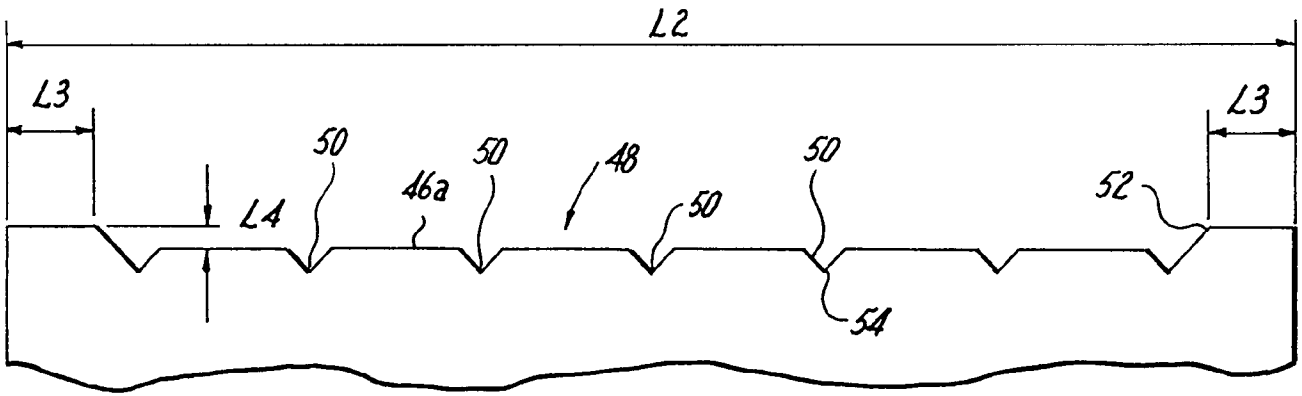
FIG. 15 is a front plan view of a second blade of the two blade knife of FIG. 13, illustrating the position of the nicks, cutting surfaces and offset that can form a second score line of a frangible section of a container constructed in accordance with the present invention.
Figure 18:
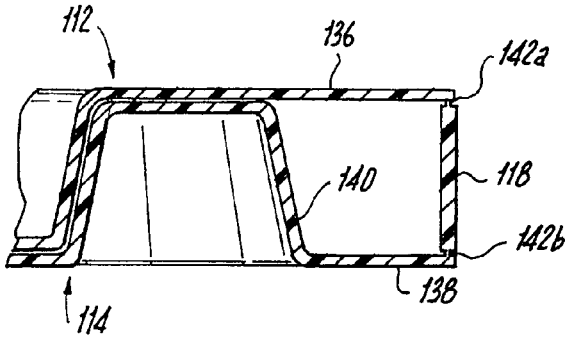
FIG. 18 is a partial cross sectional view of the container shown in FIG. 16, taken along line 18—18 of FIG. 17, illustrating in particular the configuration of the hinge, upper and lower projections and frangible section.
Figure 19:
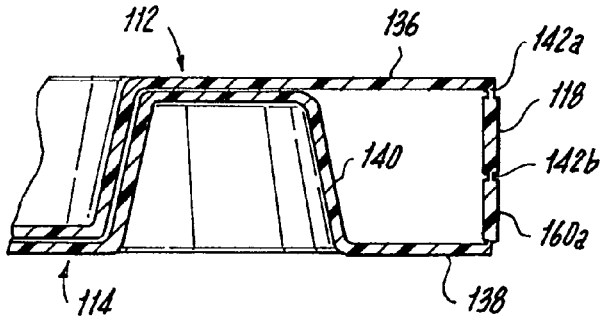
FIG. 19 is a partial cross sectional view of the container shown in FIG. 16, taken along line 19—19 of FIG. 18, illustrating in particular the configuration of the hinge, upper and lower projections, frangible section, and score line defining a tab associated with the lower projection.
Figure 20:
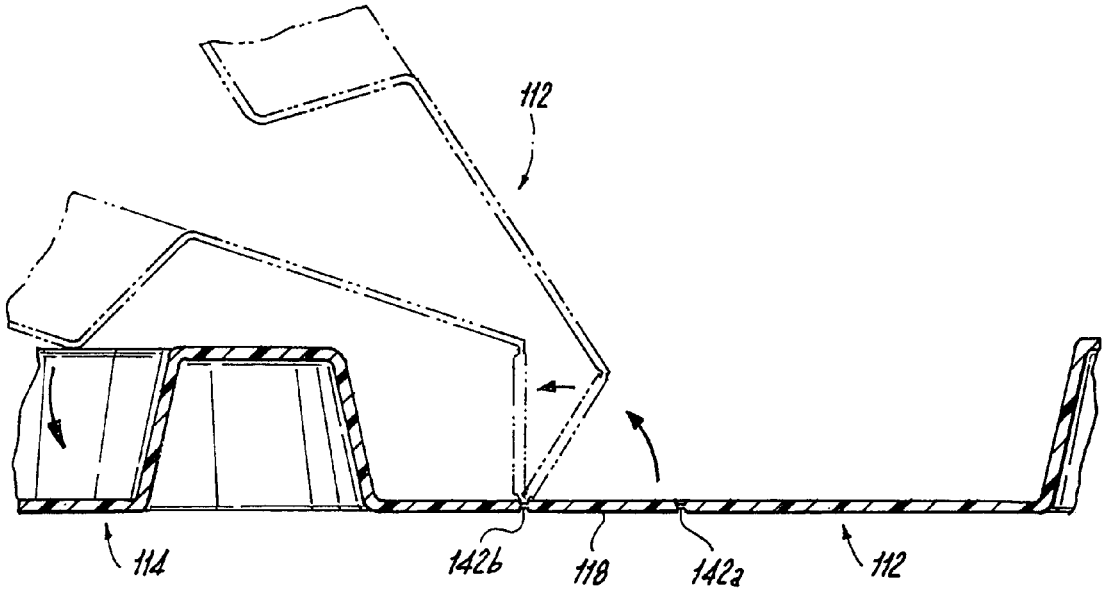
FIG. 20 is a partial cross sectional view of the container shown in FIG. 16, illustrating in particular the manner in which the cover portion is closed on the base portion.
Figure 21:
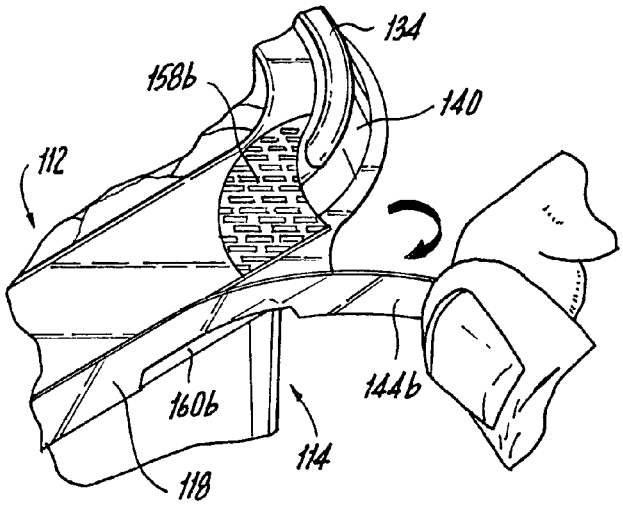
FIG. 21 is a partial perspective view of the container shown in FIG. 16, illustrating in particular the manner in which the frangible section is removed from the hinge.
Figure 22:
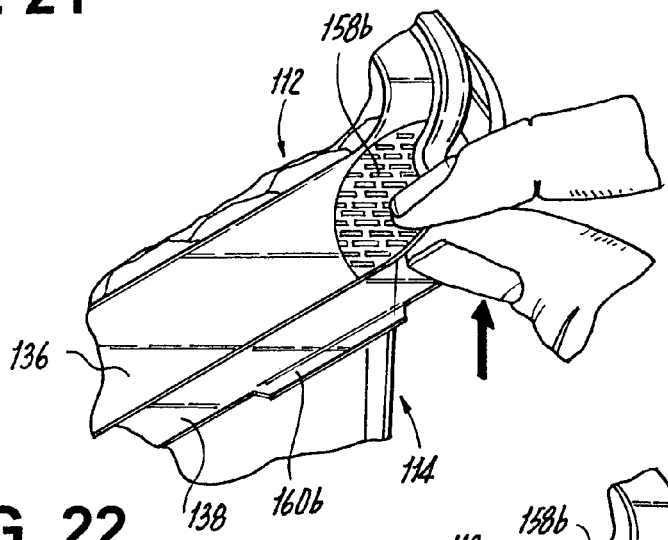
FIGS. 22–23 are partial perspective views of the container shown in FIG. 1, illustrating in particular the manner in which the separation of the cover portion from the base portion is facilitated by clasping the patterned section disposed on the upper projection or arm associated with the cover portion which is formed upon removal of the frangible section.
Figure 23:
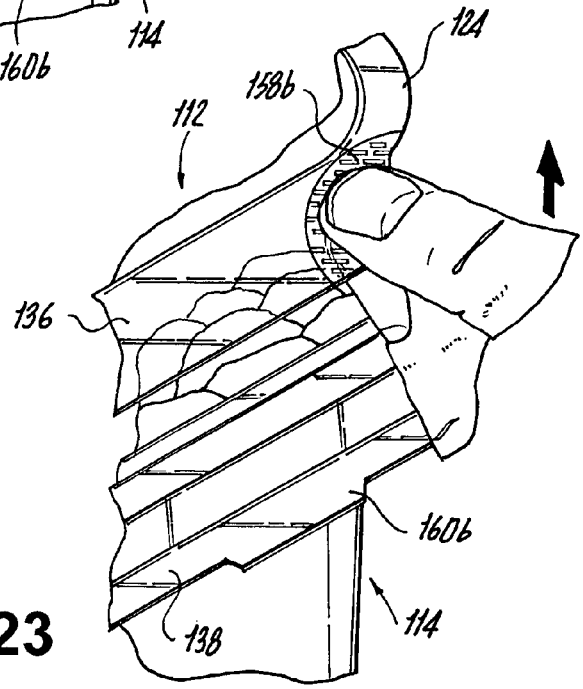

FIGS. 13–15 illustrate an exemplary configuration for a double scoring blade having blades 46*a*, 46*b*, which can be used in a punch press system or the like to form score lines 42*a*, 42*b* in accordance with the present invention. Various dimensions of blades 46*a*, 46*b* are also provided herein as a non-limiting example.

The lateral separation L1 between blades 46*a*, 46*b* is in this embodiment about 0.36 inches. The length L2 of blades 46*a*, 46*b* is about 2.25 inches. Blades 46*a*, 46*b* include an offset recessed portion 48 with a series of substantially similar nicks 50 cut therein between cutting edges 52. The width L3 of cutting edges 52 is preferably 0.36 inches. Preferably, the offset L4 between recessed portion 48 and cutting edges 52 is approximately 0.001 inches.

In this embodiment, blade 46*a* includes seven (7) nicks 50 while blade 46*b* includes eight (8) nicks 50. The nicks 50 on blade 46*a* are offset with respect to the nicks 50 on blade 46*b*, which results in a desirable zipper-like effect when removing strip 18. Preferably, nicks 50 are triangular shaped, about 0.010 inches deep and about 0.020 inches wide, and define an approximately 90 degree angle at its deepest convergence point 54. The length L5 between nicks 50, as measured between the respective convergence points 54 of adjacent nicks 50, is approximately 0.252 inches. The length L6 between the respective convergence points 54 of adjacent offset nicks 50 on blade 46*b* is about 0.126 inches. The length L7 of blades 46*a*, 46*b* is about 0.1 inches, and each blade edge defines an angle of about 45 degrees.

It should be readily understood that a container constructed in accordance with the present invention, which is preferably a plastic container used for carrying edible items, can be manufactured in a variety of shapes and sizes, and can be formed from resins or plastic materials such as polyethylene, polypropylene, polyvinyl chloride or polyethylene terephthalat ("PETE"), as well as other suitable materials or combinations thereof. The forming process can also vary to include methods such as thermo-forming, injection molding or blow molding. The container can be transparent or translucent, and may be colored in either instance. Also, vents can be provided in the container to promote airflow therethrough, if appropriate based on the intended contents of the container.

Preferably, container 10 is formed from a roll of PETE subjected to a vacuum and pressure mold with plug assist. During manufacture, blades 46*a*, 46*b* of FIGS. 13–15 are preferably applied to a newly formed container 10 to impart score lines 42*a*, 42*b* thereon. Cutting edges 52 cut substantially through the material used to make container 10. Preferably, the configuration of blades 46*a*, 46*b* are designed so that a desirable amount of force is necessary to remove strip 18, as determined by consumer trials for example. Those skilled in the art will readily appreciate that the configuration of blades 46*a*, 46*b* can be adjusted for a variety of reasons, and the above dimensions are exemplary of one embodiment of the present invention.

For example, various other methods can be employed to form frangible strip 18 of hinge 16. For example, score lines, nicks or penetrations can be created with the molding tool itself during the forming step. Alternatively, a high die forming process can be employed where, after the forming step, the container is indexed to a trim station, where one or more knives liberate the container and creates the score lines or perforations. Also, an intermittent cutter can be employed between the forming step or the trim step, a progressive punch and die operation can be employed, or a numerically controlled laser can be employed to create the nicks. It is also envisioned that electromechanical, ultra-sonic or hydrodynamic systems can be employed in the forming process.

Container 10 could also be formed with locking arrangements known in the art other than the tamper-resistant/evident closure of the subject invention, such as traditional male and female locking features.

Referring to FIGS. 16–23, there is illustrated another tamper-resistant/evident container constructed in accordance with a preferred embodiment of the subject invention and designated generally by reference numeral 110. Container 110 is similar to container 10 described above except that container 110 is rectangular in configuration rather than circular. Container 110 thus includes a base portion 112 and a cover portion 114 joined together by an integrally formed hinge 116 that defines a tamper-evident frangible pull strip 118, which must be removed before cover portion 114 can be readily removed from base portion 112.

Container 110 includes embossed or raised patterned sections 156*a* and 156*b* on opposing tabs 144*a* and 144*b* of strip 118, respectively, to facilitate removal of strip 118. Patterned sections 158*a* and 158*b* are also disposed on opposing sides of upper arm 136 to facilitate separation of cover portion 112 from base portion 114. Instructional indicia can be imprinted on upper arm 136 between patterned sections 158*a* and 158*b*.

In this embodiment, score line 142*b* is situated on hinge 116 to define two tabs 160*a* and 160*b* which are connected with lower arm 138. Tabs 160*a*, 160*b* remain in place on hinge 116 until strip 118 is removed, as can be best viewed in FIGS. 21–23. Tabs 160*a*, 160*b* extend from lower arm 138 to further facilitate gripping lower arm 138 and separation of cover portion 112 from base portion 114.

Figure 24:
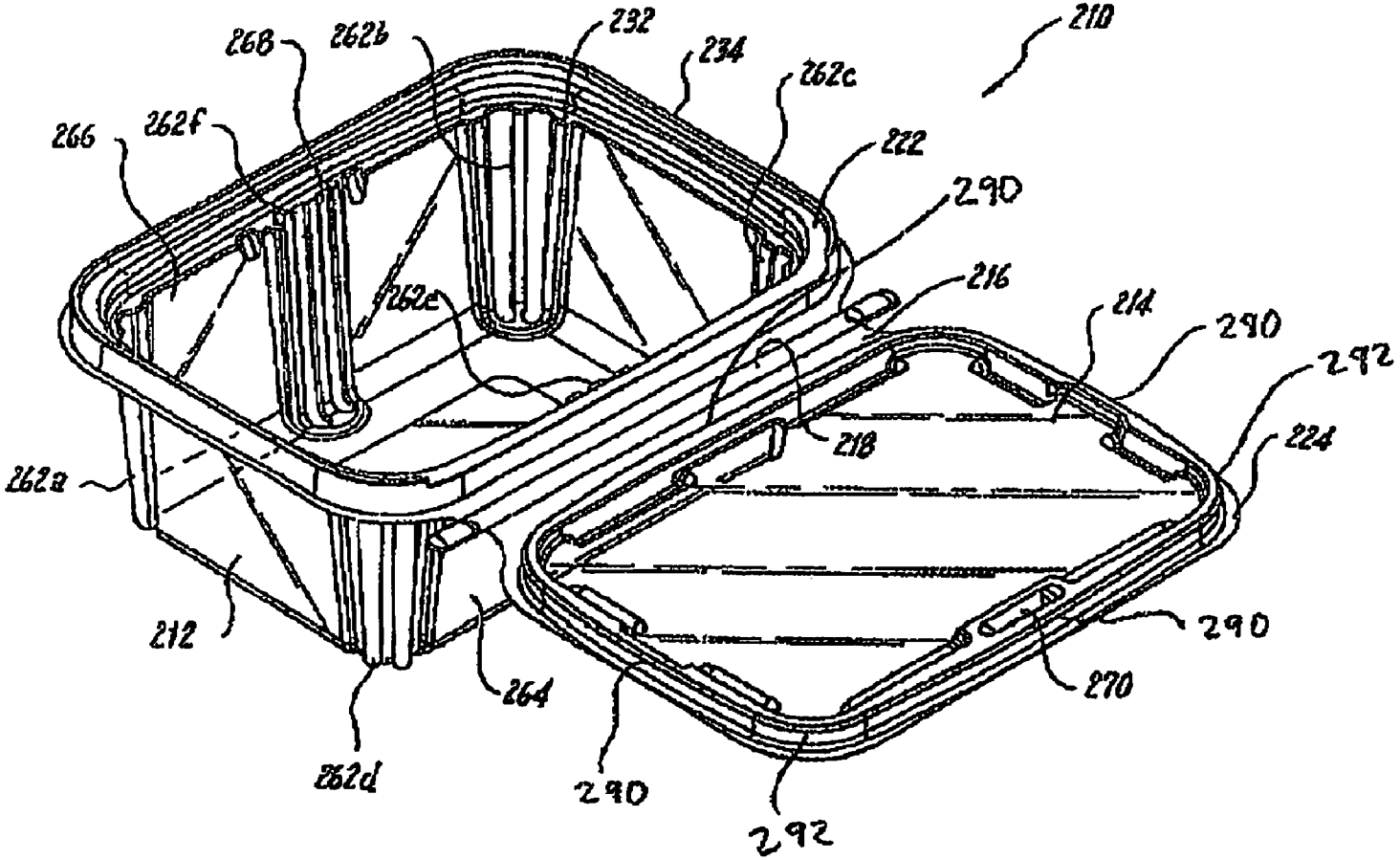
FIG. 24 is a perspective view of another embodiment of a tamper-resistant/evident container constructed in accordance with the present invention having an additional engagement mechanism and support structure for providing enhanced structural integrity and further securing the base portion and cover portion, among other things.
Figure 25:
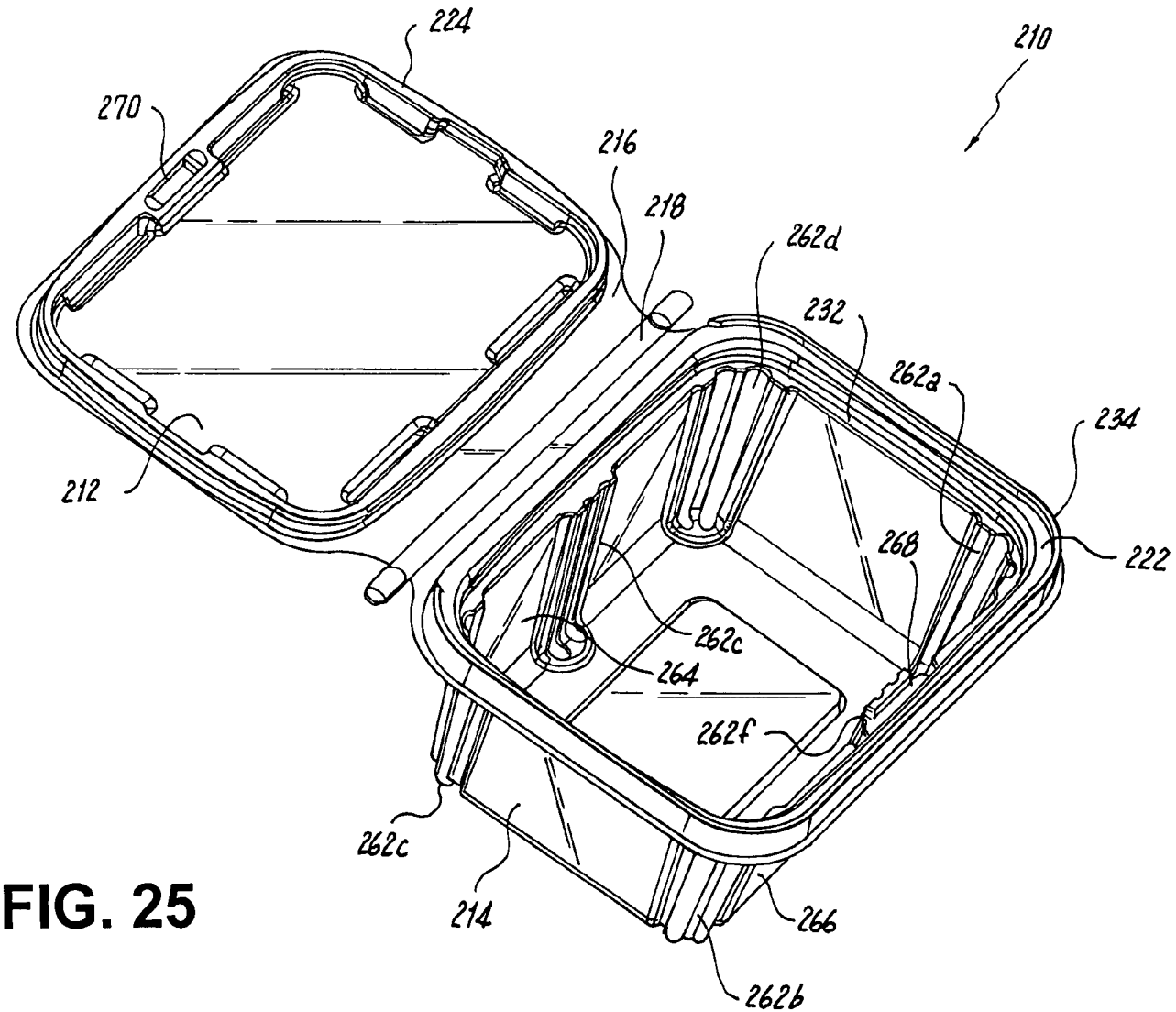
FIG. 25 is another perspective view of the tamper-resistant/evident container shown in FIG. 24.

FIGS. 24–25 illustrate another tamper-resistant/evident container constructed in accordance with a preferred embodiment of the subject invention and designated generally by reference numeral 210. Container 210 is rectangular in shape, but may formed in other shapes, and has similar features to containers 10 and 110 described above. Container 210 includes, among other things, a base portion 212 and a cover portion 214 joined, together by an integrally formed hinge 216 that defines a tamper-evident frangible pull strip 218, which must be removed before cover portion 214 can be readily removed from base portion 212. An upwardly projecting bead 234 is disposed on peripheral rim 222 of base portion 214. Bead 234 is positioned to substantially surround the outer edge of flange 224 of cover portion 212 when container 210 is closed, thus physically blocking access by fingers or any other object that could be applied to the edge of peripheral flange 224 and rim 222 for leverage while attempting to pry cover portion 212 from base portion 214.

In this embodiment, a plurality of supporting ribs 262*a–f*, each extending from about the enclosed bottom of base portion 214 to about extending rim 232 are positioned at the four corners (ribs 262*a–d*, respectively) of base portion 214 and the midpoints on hinge side wall 264 (rib 262*e*) and opposing side wall 266 (rib 262*f*) of base portion 214 to provide enhanced structural integrity. Supporting ribs 262*a–f* generally consist of multiple elongated, arcuate portions, each having a curved latitudinal cross-sectional profile, positioned adjacently with respect to one another.

As further disclosed in this embodiment, a circumferential engagement sealing interface between cover portion 214 and base portion 212 is defined in part by a plurality of outwardly bowed arcuate portions 290. As depicted, outwardly bowed arcuate portions 290 are connected by rounded corner portions 292.

Container 210 also includes an additional independent, engaging mechanism that provides even further structural integrity, enhances security by urging flange 224 to remain in position against peripheral rim 222, and facilitates the reattachment of cover portion 212 to base portion 214, among other things. A male engaging member 268 projects upwardly from supporting rib 262*f* on side wall 266 which is received by a correspondingly sized female engaging member 270 defined on cover portion 212.

Thus, when container 210 is closed, male engaging member 268 on base portion 210 and female engaging member 270 on cover portion 212 form an engagement which further secures base portion 214 to cover portion 212. In addition to urging flange 224 against rim 222, the aforementioned features increase the amount of force that would be necessary to pry cover portion 212 from base portion 214 in an unauthorized manner (i.e., without removal of strip 218).

Also, the aforementioned engagement facilitates the reattachment of cover portion 212 with base portion 214 after container 210 is opened legitimately by a consumer. Container 210 can be reclosed after purchase by urging cover portion 212 onto base portion 214, and in particular, this can be accomplished by pressing on the corners of cover portion 212, as indicated by instructional indicia printed in the outer corner areas of cover portion 212 in this embodiment. In reclosing container 210, the initial engagement of male member 268 with female member 270 facilitates the subsequent step of applying pressure on the corners of cover portion 212, making it easier to reattach cover portion 212 to base portion 214. It should be readily apparent to those skilled in the art that other engagement mechanisms, devices, engagements and container designs, and combinations thereof, could be incorporated in any embodiment in accordance with the present invention.

Although exemplary and preferred aspects and embodiments of the present invention and forming methods have been described with a full set of features, it is to be understood that the disclosed container and method of manufacture may be practiced successfully without the incorporation of each of those features. The scope of the present invention is not limited only to the tamper-resistant/evident containers and methods of manufacture disclosed herein. Thus, it is to be understood that modifications and variations may be utilized without departure from the spirit and scope of the invention and method disclosed herein, as those skilled in the art will readily understand. Such modifications and variations are considered to be within the purview and scope of the appended claims and their equivalents.

What is claimed is:

1. A tamper-resistant/evident container comprising:

a) a cover portion including an outwardly extending peripheral flange;

b) a base portion including an upper peripheral edge forming at least in part an upwardly projecting bead extending substantially about the perimeter of the base portion and configured to render the outwardly extending flange of the cover portion relatively inaccessible when the container is closed, wherein the cover portion and base portion are adapted and configured to lock together about their periphery by way of a circumferential engagement sealing interface, wherein the circumferential engagement sealing interface is defined at least in part by a perimeter having a plurality of arcuate segments and rounded corner portions; and c) a lock for maintaining the peripheral flange adjacent to the upper peripheral edge when the container is closed.

2. A tamper-resistant/evident container as recited in claim 1, further comprising:

d) a hinge joining the outwardly extending flange of the cover portion with the base portion, the hinge including a frangible section, which upon severing, provides a projection that extends out beyond the upwardly projecting bead of the upper peripheral edge of the base portion, for facilitating disengagement of the lock and removal of the cover portion from the base portion to open the container.

3. A tamper-resistant/evident container as recited in claim 2, wherein a skirt depends downwardly from the upper peripheral edge of the base portion, and the hinge extends from a lower edge of the skirt to the outwardly extending flange of the cover portion.

4. A tamper-resistant/evident container as recited in claim 2, wherein the lock facilitates the reattachment of the cover portion with the base portion.

5. A tamper-resistant/evident container as recited in claim 4, wherein the lock is disposed along one of the arcuate segments, and is configured and adapted to urge the peripheral flange of the cover portion and the upper peripheral edge of the base portion to remain adjacent with respect to each other when the container is closed by securing the cover portion to the base portion.

6. A tamper-resistant/evident container as recited in claim 1, wherein the lock includes corresponding male and female engaging members.

7. A tamper-resistant/evident container as recited in claim 6, wherein the male engaging member is defined on the base portion and the female engaging member is defined on the cover portion.

8. A tamper-resistant/evident container as recited in claim 1, further comprising:

d) a support disposed on the base portion proximate the lock configured and adapted to resist a load imposed downwardly on the cover portion of the container.

9. A tamper-resistant/evident container as recited in claim 8, wherein the base portion is rectangular and the support includes ribs disposed adjacent each corner of the base portion.

10. A tamper-resistant/evident container comprising:

a) a cover portion including an outwardly extending peripheral flange;

b) a base portion including an upper peripheral edge, wherein the cover portion and base portion are adapted and configured to lock together about their periphery by way of a circumferential engagement means;

c) a hinge joining the outwardly extending flange of the cover portion with the base portion, the hinge including a frangible section, which upon severing, provides a projection extending outwardly from the base portion, for facilitating removal of the cover portion from the base portion to open the container;

d) a latch disposed proximate the circumferential engagement means for maintaining the peripheral flange adjacent to the upper peripheral edge when the container is closed; and e) at least one supporting rib defined on the base portion and including a plurality of elongated arcuate portions positioned adjacently with respect to one another.

11. A tamper-resistant/evident container as recited in claim 10, further comprising an upwardly projecting bead extending substantially about the perimeter of the base portion configured to render the outwardly extending flange of the cover portion relatively inaccessible when the container is closed.

12. A tamper-resistant/evident container as recited in claim 10, wherein at least one of the engagement means and the latch facilitates the reattachment of the cover portion with the base portion.

13. A tamper-resistant/evident container as recited in claim 10, wherein the latch is disposed proximate the circumferential engagement means, and urges the peripheral flange of the cover portion and the upper peripheral edge of the base portion to resist separation when the container is closed.

14. A tamper-resistant/evident container as recited in claim 10, wherein the latch includes corresponding male and female engaging members.

15. A tamper-resistant/evident container as recited in claim 14, wherein the male engaging member is defined on the base portion and the female engaging member is defined on the cover portion.

16. A tamper-resistant/evident container as recited in claim 10, wherein a male engaging member of the latch extends from the at least one supporting rib.

17. A tamper-resistant/evident container comprising:

a) a cover portion including an outwardly extending peripheral flange;

b) a base portion including an upper peripheral edge forming at least in part an upwardly projecting bead extending substantially about the perimeter of the base portion and configured to render the outwardly extending flange of the cover portion relatively inaccessible when the container is closed;

c) a hinge joining the outwardly extending flange of the cover portion with the base portion, the hinge including a frangible section, which upon severing, provides a projection including tabs extending outwardly from the base portion for facilitating removal of the cover portion from the base portion to open the container;

d) a male engaging member defined on the base portion to project towards the cover portion when the container is closed; and e) a female engaging member having a receiving portion defined on the cover portion to correspond to the position or the male engaging member when the container is closed for receiving the male engaging member therein and forming a non-permanent engagement between the male and female engaging members when the container is closed.

18. A tamper-resistant/evident container as recited in claim 17, wherein the engagement of the male and female members provide resistance to force applied to remove the cover portion and base portion and urge the outwardly extending peripheral flange of the cover portion into contact with the peripheral edge of the base portion.

19. A tamper-resistant/evident container as recited in claim 1, wherein the cover portion is adapted and configured to be mated with the base portion along the circumferential engagement sealing interface by pressing downwardly on one or more corners of the cover portion.

20. A tamper-resistant/evident container as recited in claim 1, wherein the circumferential engagement sealing interface includes four arcuate segments.

21. A tamper-resistant/evident container as recited in claim 1, wherein the arcuate segments are outwardly bowed.

22. A tamper-resistant/evident container as recited in claim 17, wherein the engagement between the male and female engaging members increases the amount of force that would be necessary to separate the cover portion from the base portion without removal of the frangible section.

23. A tamper-resistant/evident container as recited in claim 5, wherein the lock is disposed along a portion of the container substantially opposite the hinge.

24. A tamper-resistant/evident container as recited in claim 10, wherein the latch is disposed along a portion of the container substantially opposite the hinge.

25. A tamper-resistant/evident container as recited in claim 17, wherein the male engaging member and female engaging member are disposed along a portion of the container substantially opposite the hinge.

26. A tamper-resistant/evident container as recited in claim 10, wherein a skirt depends downwardly from the upper peripheral edge of the base portion, and the hinge extends from a lower edge of the skirt to the outwardly extending flange of the cover portion.

27. A tamper-resistant/evident container as recited in claim 17, wherein a skirt depends downwardly from the upper peripheral edge of the base portion, and the hinge extends from a lower edge of the skirt to the outwardly extending flange of the cover portion.

* * * * *